United States Patent [19]

Saito

[11] 4,250,573

[45] Feb. 10, 1981

[54] DIGITAL ALARM WRISTWATCH

[75] Inventor: Toshiaki Saito, Suwa, Japan

[73] Assignee: Kabushiki Kaisha Suwa Seikosha, Tokyo, Japan

[21] Appl. No.: 967,034

[22] Filed: Dec. 6, 1978

Related U.S. Application Data

[63] Continuation of Ser. No. 796,102, May 12, 1977, abandoned.

[30] Foreign Application Priority Data

May 12, 1976 [JP] Japan ..... 51-59655[U]

[51] Int. Cl.[3] ..... G04C 21/16; G04B 37/00; G08B 3/00

[52] U.S. Cl. ..... 368/73; 368/250; 368/289; 340/387

[58] Field of Search ..... 58/38 R, 38 A, 52–56, 58/57.5, 88 R, 90 R; 368/12, 72, 73, 250, 255, 278, 286, 291, 292; 340/384 R, 384 E, 387

[56] References Cited

U.S. PATENT DOCUMENTS

| | | | |
|---|---|---|---|
| 3,462,943 | 8/1969 | Spadini et al. | 58/57.5 |
| 3,577,876 | 5/1971 | Spadini | 58/57.5 |
| 3,638,418 | 2/1972 | Spadini | 58/57.5 |
| 3,858,389 | 1/1975 | Isuruishi | 58/57.5 |
| 4,068,461 | 1/1978 | Fassett et al. | 58/57.5 |

*Primary Examiner*—Edith S. Jackmon

*Attorney, Agent, or Firm*—Blum, Kaplan, Friedman, Silberman and Beran

[57] ABSTRACT

A digital display electronic alarm wristwatch which includes a watch case, a cover glass and a case back contains an electro-optical display device, electronic watch body and an alarm buzzer mounted in the watch case and case back not to overlap with the display device in plan view. The watch case is formed with buzzer cover holes on the display side of the case for releasing the alarm buzzer sound.

4 Claims, 1 Drawing Figure

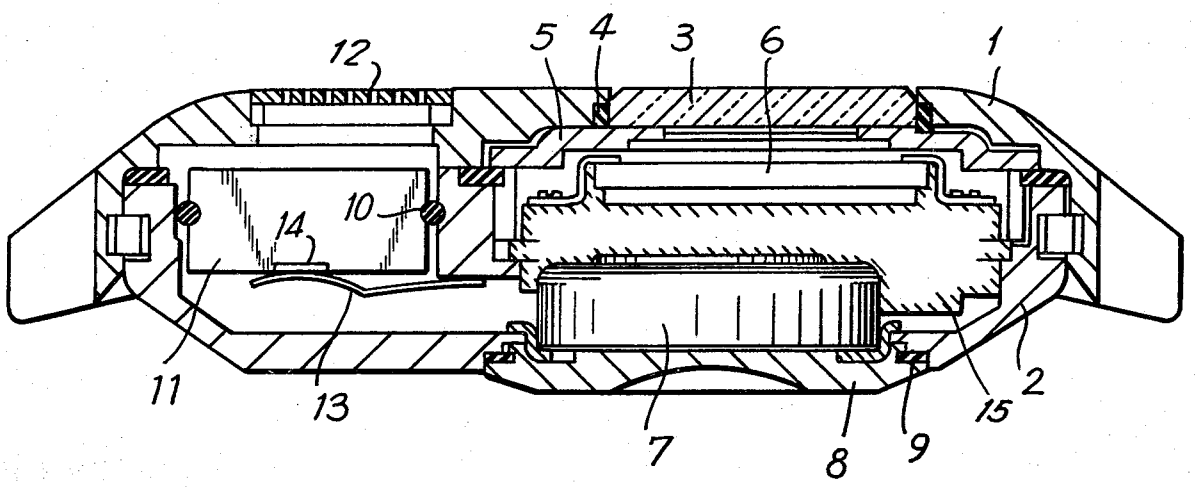
1
2
15
9
8
6
3
7
4
5
12
10
13
14
11

DIGITAL ALARM WRISTWATCH

This is a continuation of application Ser. No. 796,102, filed on May 12, 1977 now abandoned.

BACKGROUND OF THE INVENTION

This invention relates generally to a digital alarm wristwatch with an electro-optical display device. In conventional electronic alarm wristwatches, the alarm buzzer is positioned in the back side of the watch below the digital display. The alarm sound is released from the back of the watch case so that the sound is interrupted by the wearer's wrist. As an electronic alarm wristwatch is driven by a small button-type battery, sufficient sound cannot be obtained by conventional placement of the alarm buzzer in the back side of the watch below the display device. When holes are provided for releasing the alarm sound on the back side, they may not be provided on the flat portion, but must be placed on a slanted portion of the case back in order to prevent interruption of sound by the wearer's wrist. When a cover for the battery is also provided, the case back becomes very complicated. This arrangement frequently results in the display panel, buzzer and battery overlapping each other, which results in a thick wristwatch.

SUMMARY OF THE INVENTION

Generally speaking, in accordance with the invention, a digital alarm wristwatch with an electro-optical display device is provided which overcomes the disadvantages of prior conventional alarm wristwatches. The digital alarm wristwatch constructed and arranged in accordance with the invention includes an alarm buzzer positioned in the wristwatch so as not to overlap with the display panel in plan view and an alarm releasing means on the display side of the watch to prevent the alarm sound from being interrupted by the wearer's wrist.

Accordingly, it is an object of this invention to provide an improved digital alarm wristwatch.

Another object of the invention is to provide an improved digital alarm wristwatch which is thin.

A further object of the invention is to provide an improved digital alarm wristwatch wherein the alarm buzzer sound is not interrupted by the wearer's wrist.

Still another object of the invention is to provide an improved digital alarm wristwatch containing holes on the display side for releasing the buzzer alarm sound.

Still a further object of the invention is to provide an improved digital alarm wristwatch which is waterproof.

Still other objects and advantages of the invention will in part be obvious and will in part be apparent from the specification and drawing.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWING

For a fuller understanding of the invention, reference is had to the following description taken in connection with the above accompanying drawing, in which:

The single FIGURE is a cross sectional view of a digital alarm wristwatch constructed in accordance with the instant invention.

DESCRIPTION OF THE PREFERRED EMBODIMENT

Referring now to the drawing, an electro-optical digital display alarm wristwatch constructed in accordance with the instant invention is shown. Watch case 1, glass cover 3 and watch case back 2 define the outer periphery of the wristwatch. Watch case back 2 is mounted releasably in watch case 1. Watch case 1 and watch case back 2 are formed with several internal recessed areas and chambers for selective placement of the internal workings of a digital watch and alarm buzzer. Watch case 1 and case back 2 are constructed to define two distinct chambers in the wristwatch so that alarm buzzer 11 may be positioned in the wristwatch in nonoverlapping relationship to the digital display means in plan view. A first chamber contains battery 7, watch body 15 and display means 6. A second chamber contains alarm buzzer 11.

Specifically, watch case 1 is formed with an opening above the first chamber and a peripheral lip about the opening. Glass packing 4 is positioned in the lip in watch case 1 and compressed against watch case 1 in the radial direction by glass cover 3. Mask 5 sits below glass cover 3 and is engaged between glass cover 3 and watch case 2. Mask 5 covers the upper surface of watch body 15 other than electro-optical display means 6. Display means 6, may be any conventional digital display means commonly used in digital wristwatches, such as, light emitting diode or liquid crystal display means. Case back 2 is mounted releasably in watch case 1 and is formed with an opening for access to battery 7 for replacement thereof.

Battery 7 is mounted in the watch case from below through said opening and is secured in position by battery cover 8 which is mounted releasably in the opening in case back 2. Battery gasket 9 is positioned on a peripheral flange of battery cover 8 and is compressed between back cover 8 and a surface of case back 2 to provide a seal between battery cover 8 and case back 2.

Alarm buzzer 11 is shown in position in a second separate chamber defined by watch case 1 and case back 2. The second chamber is adjacent to and in nonoverlapping relationship to display means 6 in plan view. Thus, alarm buzzer 11 does not overlap with display means 6 or battery 7 when viewed from the display side of the wristwatch. Alarm buzzer 11 is formed with contacts 14 (only one of which is shown) which abut terminals 13 (only one of which is shown) for providing electric current to alarm buzzer 11. Alarm buzzer 11 is mounted in watch back 2 and compresses alarm buzzer gasket 10 in the radial direction against the portion of case back 2 defining the second chamber to provide a water-tight seal. Watch case 1 is formed with a further opening on the top surface thereof positioned above the alarm buzzer chamber and adjacent to display means 6 and glass cover 3. Buzzer cover 12 formed with a plurality of holes therethrough is received and retained in said further opening. Buzzer 11 is positioned so that the diaphram thereof is facing buzzer cover 12 for the transmission of the buzzer sound through the holes in said buzzer cover.

In a digital alarm wristwatch constructed in accordance with the invention, the buzzer alarm sound is released from the display side of the wristwatch without being interrupted by the wearer's wrist. This permits a sufficient sound to alert the wearer even though a small button-type battery is used to provide electricity to the watch mechanism as well as the alarm buzzer. This construction also permits a reduction in thickness of the wristwatch, resulting in an aesthetically more desirable watch. Further, by providing the alarm buzzer on the display side of the watch, one may glance at the watch and know that it is an alarm wristwatch.

In addition, to these highly desirable design considerations, a digital alarm wristwatch constructed in accordance with the instant invention is also waterproof. When the wristwatch is submerged in water, water enters alarm buzzer holes 12 as far as the vibrating diaphram surface of buzzer 11 and buzzer gasket 10. Water does not enter the lower portion of the alarm buzzer chamber or the battery and watch body chamber due to positioning of buzzer gasket 10 between alarm buzzer 11 and case back 2.

It will thus be seen that the objects set forth above, those made apparent from the preceding description, are efficiently obtained and, since certain changes may be made in the above construction without departing from the spirit and scope of the invention, it is intended that all matter contained in the above description or shown in the accompanying figure will be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic alarm wristwatch case for supporting an alarm buzzer and digital display therein, comprising:

a watch case having a front display surface and an interior, said display surface formed with at least one display opening and alarm buzzer opening on said display side and said interior formed with a first chamber for receiving time display means in registration with said display opening and a second chamber for receiving alarm buzzer means in registration with said buzzer opening, said first chamber and said second chamber in non-overlapping relation in plan view, said chambers openly communicating with each other on the back side of said wristwatch away from said buzzer cover opening for providing electrical connection between said first chamber and the alarm buzzer means in the second chamber;

time display means disposed within said watch case in said first chamber for viewing through said display opening; and alarm buzzer means disposed within said second chamber so that said alarm buzzer means does not overlap said display means in plan view and sound emanating from said alarm buzzer means escapes through said buzzer openings in said display surface without being interrupted by a users wrist and a gasket means in said second chamber and surrounding said buzzer for watersealing the interior of the wristwatch case.

2. The wristwatch case of claim 1, wherein said alarm buzzer means includes a vibrating diaphragm disposed on the side of said gasket means towards said buzzer opening.

3. The wristwatch case of claim 1, including a battery in the interior of said case, said battery overlapping the first chamber.

4. The wristwatch of claim 3, wherein said display means is a liquid crystal display device.

* * * * *